US008096327B2

(12) United States Patent
Hirz

(10) Patent No.: US 8,096,327 B2
(45) Date of Patent: Jan. 17, 2012

(54) AEROSOL CAN FILLING SYSTEM

(75) Inventor: Donald J. Hirz, Willowick, OH (US)

(73) Assignee: Tungsten Capital Partners, LLC, South Euclid, OH (US)

( * ) Notice: Subject to any disclaimer, the term of this patent is extended or adjusted under 35 U.S.C. 154(b) by 1117 days.

(21) Appl. No.: 11/836,170

(22) Filed: Aug. 9, 2007

(65) Prior Publication Data

US 2009/0038708 A1 Feb. 12, 2009

(51) Int. Cl.
*B65B 3/04* (2006.01)

(52) U.S. Cl. ..... 141/20; 141/3; 141/349

(58) Field of Classification Search ..... 141/3, 20, 141/21, 26, 67, 253, 275, 277, 349, 351; 222/402.1

See application file for complete search history.

(56) References Cited

U.S. PATENT DOCUMENTS 2,759,647 A * 8/1956 Boyer ..... 141/38
3,797,534 A * 3/1974 Skidmore ..... 141/3
D361,581 S 8/1995 Hirz
5,535,790 A 7/1996 Hirz
5,740,841 A 4/1998 Hirz
6,948,534 B1 9/2005 Hirz

* cited by examiner

*Primary Examiner* — Gregory Huson
*Assistant Examiner* — Jason Niesz
(74) *Attorney, Agent, or Firm* — Pearne & Gordon LLP

(57) ABSTRACT

A system for filling pre-charged aerosol cans comprising a frame, a power actuator on the frame having an output member that extends forcibly downwardly through a stroke of fixed length and retracts upwardly, a combined reservoir and filling head supported in the frame generally below the output member, the filling head having a cylindrical dispensing bore and an outlet below the bore adapted to be coupled to the valve of the aerosol can, a dispensing piston with a lower face operable in the bore to create hydraulic pressure on liquid received in the bore from the reservoir, a set of cooperating elements for coupling a dispensing piston to the output member selectively at a plurality of predetermined fixed spacings from the output member, whereby the volume of fluid displaced from the dispensing chamber by the dispensing piston is regulated to fill cans of different capacity while the output member of the power actuator traverses its stroke of constant length.

13 Claims, 5 Drawing Sheets

AEROSOL CAN FILLING SYSTEM

BACKGROUND OF THE INVENTION

The invention relates to apparatus for injecting liquid into pre-charged aerosol cans.

PRIOR ART

My prior U.S. Pat. Nos. 5,535,790, 5,740,841, and 6,948,534 disclose examples of can filling apparatus of varying complexity and features. The apparatus shown in these patents and the products of others range from simple manually operated devices to semi-automatic power-operated apparatus. There has remained a need for power-operated apparatus that is simple in construction, economical to manufacture, easy and safe to operate, relative fast in operation, and compatible with cans of various sizes and different style valves.

SUMMARY OF THE INVENTION

The invention provides power operated apparatus for filling pre-charged aerosol cans with predetermined quantities of liquids. The apparatus is operated by a pneumatic piston that drives a liquid displacing piston, in tandem with the pneumatic piston, through a swept volume sufficient to fill a can of maximum designated size with a single stroke. The apparatus preferably includes a set of piston rod extensions of different lengths, each length corresponding to a particular size can to be filled. The apparatus also preferably includes a set of pistons of various heights for fine regulation of the amount of liquid to be injected into a pre-charged container so as to adjust, for example, the fill where the density of the liquid material being dispensed into the can varies from product to product and the fill condition is determined by weight.

The disclosed filling apparatus preferably is both pneumatically controlled and pneumatically power driven making its installation a simple matter of connecting it to an air line and making its operation free of electrical hazards. The pneumatic control system provides a pair of interlocks that assure a can is in place and is not overfilled and that a protective door is closed and latched before and while pump injecting action occurs.

The filling system afforded by the invention meets the need for a device with the capacity to quickly and efficiently fill cans of different sizes, cans of different valve styles, and with the ability to adjust the fill quantity. This is accomplished with the invention using automatic controls that afford the safety features referenced above and that are simple and reliable.

Central to the simplicity of the filling system of the invention is an arrangement and operation strategy where a single stroke of a dispensing piston is sufficient to fill the largest can size for which the system is designed. When cans of a lesser volume are being filled, the apparatus is fitted with a dispensing piston rod extension having a correspondingly shorter length. A set of pistons of various heights, each compatible with any piston rod extension, additionally enables the dispensing volume to be closely adjusted to account for density variations.

Cans with a particular style of valve with a male tip are difficult to fill with practical speeds when dispensing piston pressure is necessarily limited. This difficulty is the result of an obstruction to inlet flow to the can presented by a check ball used in the filling device to prevent escape of liquid from a supply reservoir when not coupled to a can valve. In accordance with the invention, a deflector element is interposed in the path the check ball takes when the ball is lifted from a seat in the filling head by the insertion of the valve tip of the can to be filled. The deflector, while allowing the check valve ball to fully seal on the seat is operable to displace the ball laterally off the top of the can valve member when the latter moves the ball off its seat.

DESCRIPTION OF THE PREFERRED EMBODIMENTS

Figure 1:
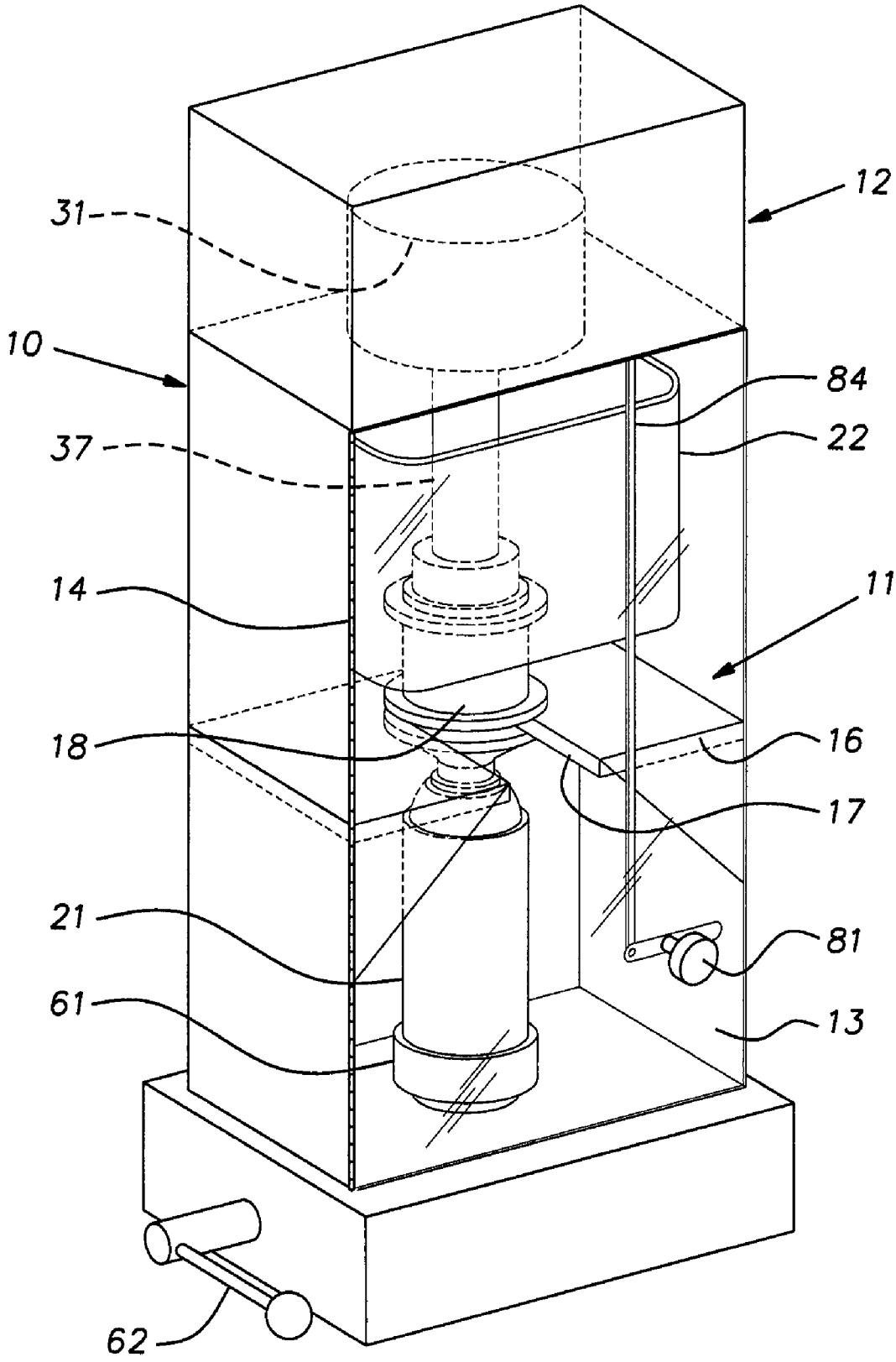
FIG. 1 is a somewhat schematic perspective view of the housing and general arrangement of the can filling system of the invention.
Figure 2:
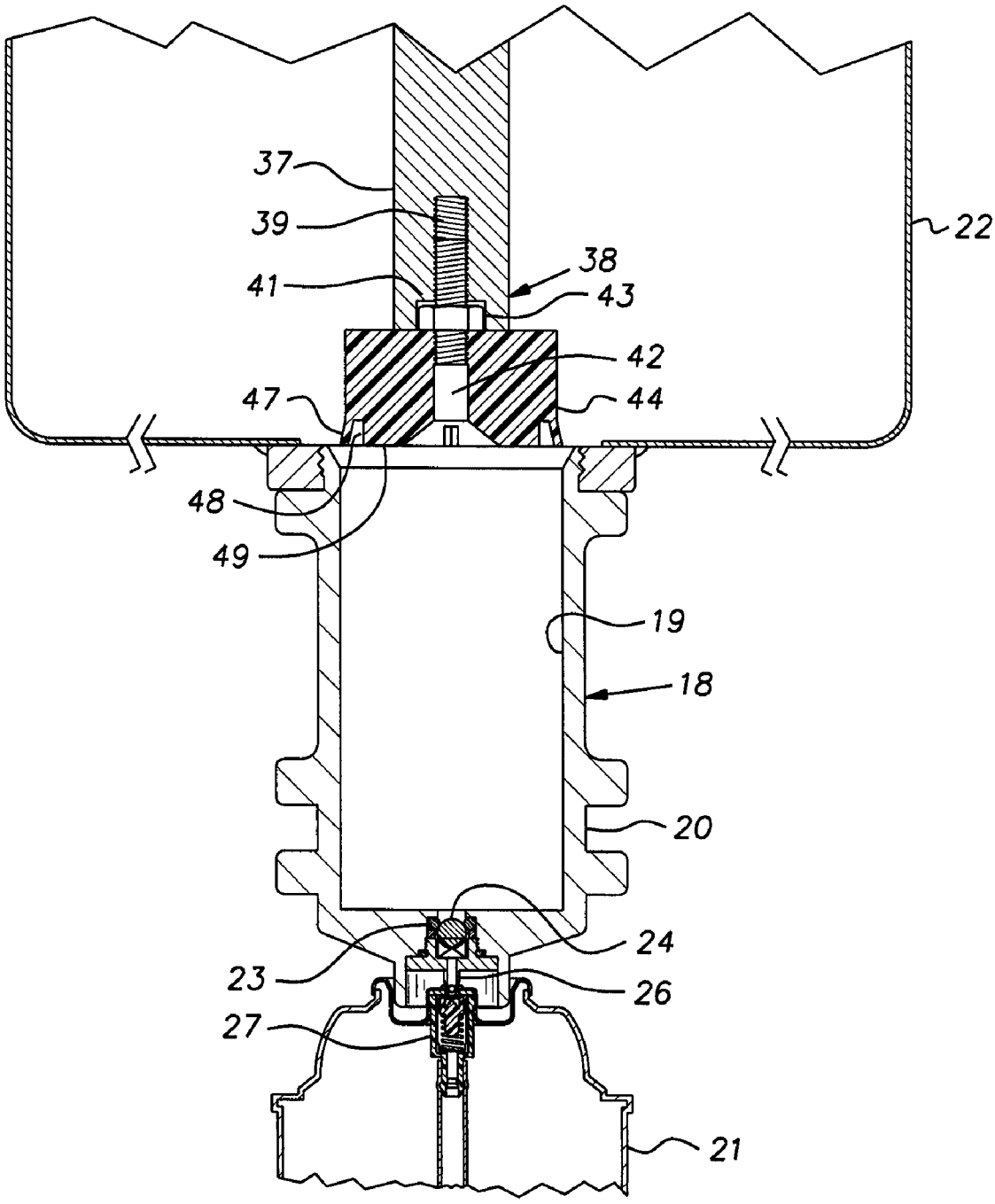
FIG. 2 is a somewhat diagrammatic, fragmentary cross-sectional view of a filling head area of the can filling system.

A filling system of the invention in the illustrated embodiment has a housing frame 10 that encloses a reservoir and can receiving area 11 and a pneumatic control and actuator compartment 12 overlying the receiving area. The housing frame 10 is fabricated primarily of sheet metal forming a rectangular cabinet. A door 13 opens and closes for access to the reservoir and can receiving area 11. The door 13, formed of a heavy sheet of polycarbonate or other preferably transparent suitable material is carried by a piano-type hinge 14 along one vertical edge.

At a mid-section of the receiving area 11, is a horizontal support plate 16 rigidly attached to the sides of the housing 10. The support plate 16 has a laterally centered slot 17 open at an edge facing the door 13. Either of two different filling heads 18, described first, and 118, described below, are received in the slot 17. The filling head 18 has a central cylindrical bore 19 forming a pumping chamber from which liquid, for example, paint, is forced into a pre-charged aerosol can 21. The filling head 18 is removably coupled in a liquid tight manner by threading it into a boss on the bottom of a liquid reservoir 22. The reservoir 22 can be an open top rectangular pan optionally fitted with a cover. The filling head 18 and reservoir 22 can be fabricated of aluminum, for example. The filling head 18 has a peripheral groove 20 that interfits with the slot 17 enabling the head, carrying the reservoir 22 to be slid onto the support plate 16.

U.S. Pat. No. 6,948,534, the disclosure of which is incorporated herein by reference, explains details of a dispensing valve 23 at the lower end of the filling head 18. Briefly, when a ball 24 is forced off its seat, liquid in the reservoir 22 is dispensed through a hollow injector pin 26 into a female valve 27 of a can 21.

A pneumatic actuator 31 in the form of a piston 32 and cylinder 33 (schematically shown in FIG. 3) is contained in the compartment 12. The piston 32 is relatively large, being, for example, 5 inches in diameter. A piston rod 34, representing the output of the actuator 31, has its free end extending into the reservoir and can receiving area 11 and is internally threaded for receiving a short externally threaded stud 36 of a piston rod extension 37. The piston rod extension at a lower end 38 has an axial threaded bore 39 and a counter bore 41 to receive the end of a machine screw 42 and a nut 43, respectively. The machine screw 42 serves to retain a dispensing piston 44 on the piston rod extension 37.

The dispensing piston 44, which preferably is formed of a thermoplastic material such as Delrin® or other suitable material, has an integral peripheral sealing skirt 47 formed by the presence of a deep groove 48 in its lower pressure developing face 49. The body of the piston 44 has a reduced outside diameter rearward of the sealing skirt 47. The groove 48 allows for limited radial movement of the sealing skirt 47 or ring to properly fit the filling head bore 19 and increase its sealing capacity with this bore in proportion to the pressure being developed by the piston 44.

When the pneumatic piston 33 (FIGS. 3 and 7), is driven downwardly by air pressure introduced into a chamber 56 above the piston, the dispensing piston 44, carried by the piston rod extension 37, is driven into the filling head bore 19 so as to express liquid in this bore past the ball valve 23 through the injector pin or stem 27 into the can 21. The reservoir 22 preferably has the capacity to store enough liquid to fill a plurality of cans. For example, the reservoir can contain enough liquid to fill twenty six (26) 16 ounce cans and proportionately more cans when the latter are of smaller size.

Figure 3:
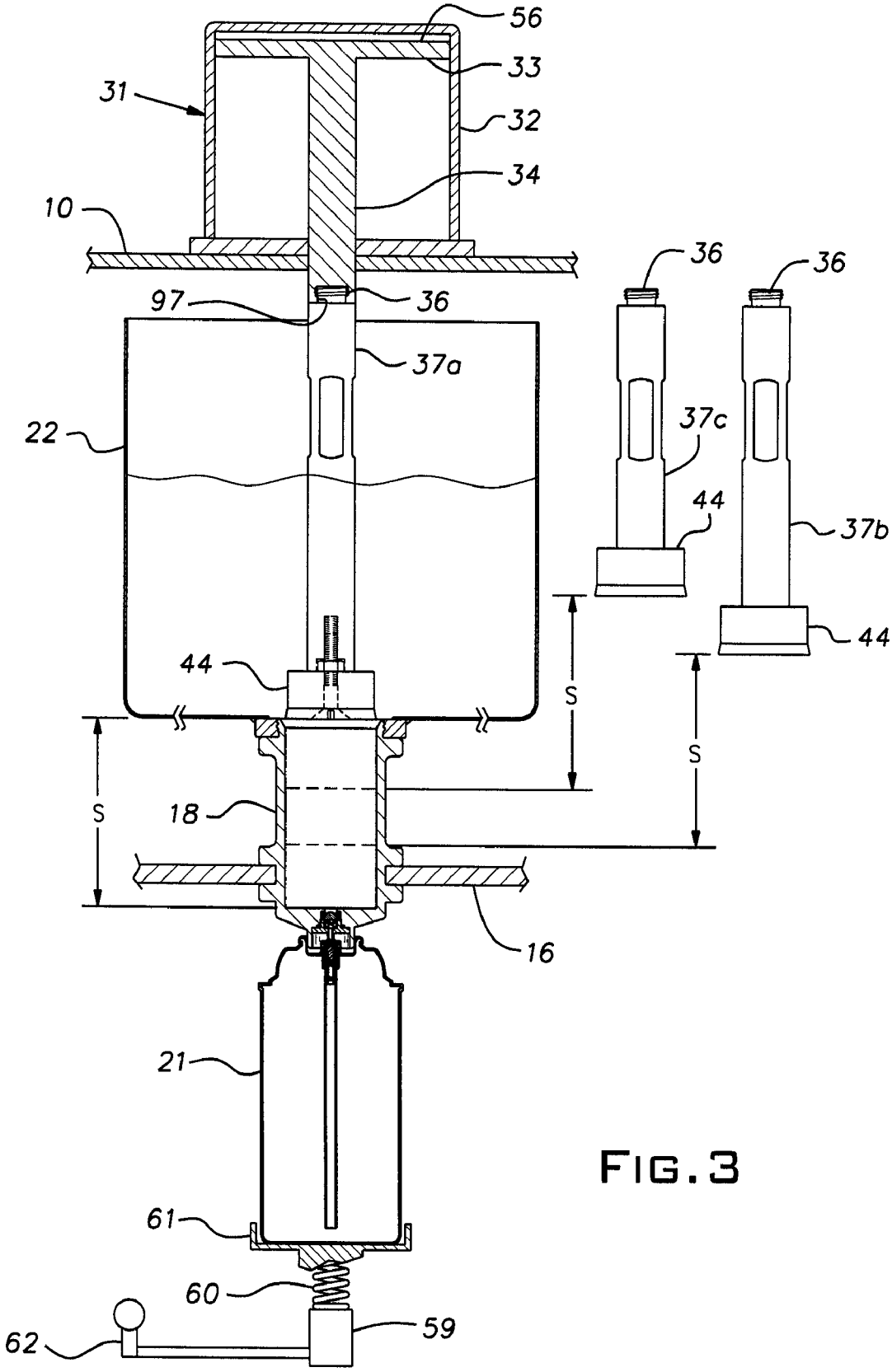
FIG. 3 is a diagrammatic showing of the can filling system illustrating the methodology of accommodating different size cans using a set of piston rod extensions of different lengths.

A can 21 is manually loaded in the area 11 of the housing on a platform 61. The platform 61 is raised by manually operating a lever 62 that turns a cam 59 to move the platform upwardly through force developed in a spring 60 (FIG. 3). Reference can be made to U.S. Pat. No. 5,535,790 for details of a mechanism for raising the platform. As the can 21 is raised by the platform 61, the fill head injector pin or stem 26 pushes into the valve of the can 21.

As suggested in FIG. 3, when the pneumatic piston 33 is fully retracted, the dispensing piston 44 is out of the filling head pumping chamber 19 thereby allowing liquid in the reservoir 22 to fill into this chamber. When the pneumatic piston 33 has pressurized air introduced into the chamber 56 above it, it descends and forces the dispensing piston 44 into the filling head chamber 19 such that the ball valve 23 is opened and liquid flows from the pumping chamber 19 into the can 21.

Figure 7:
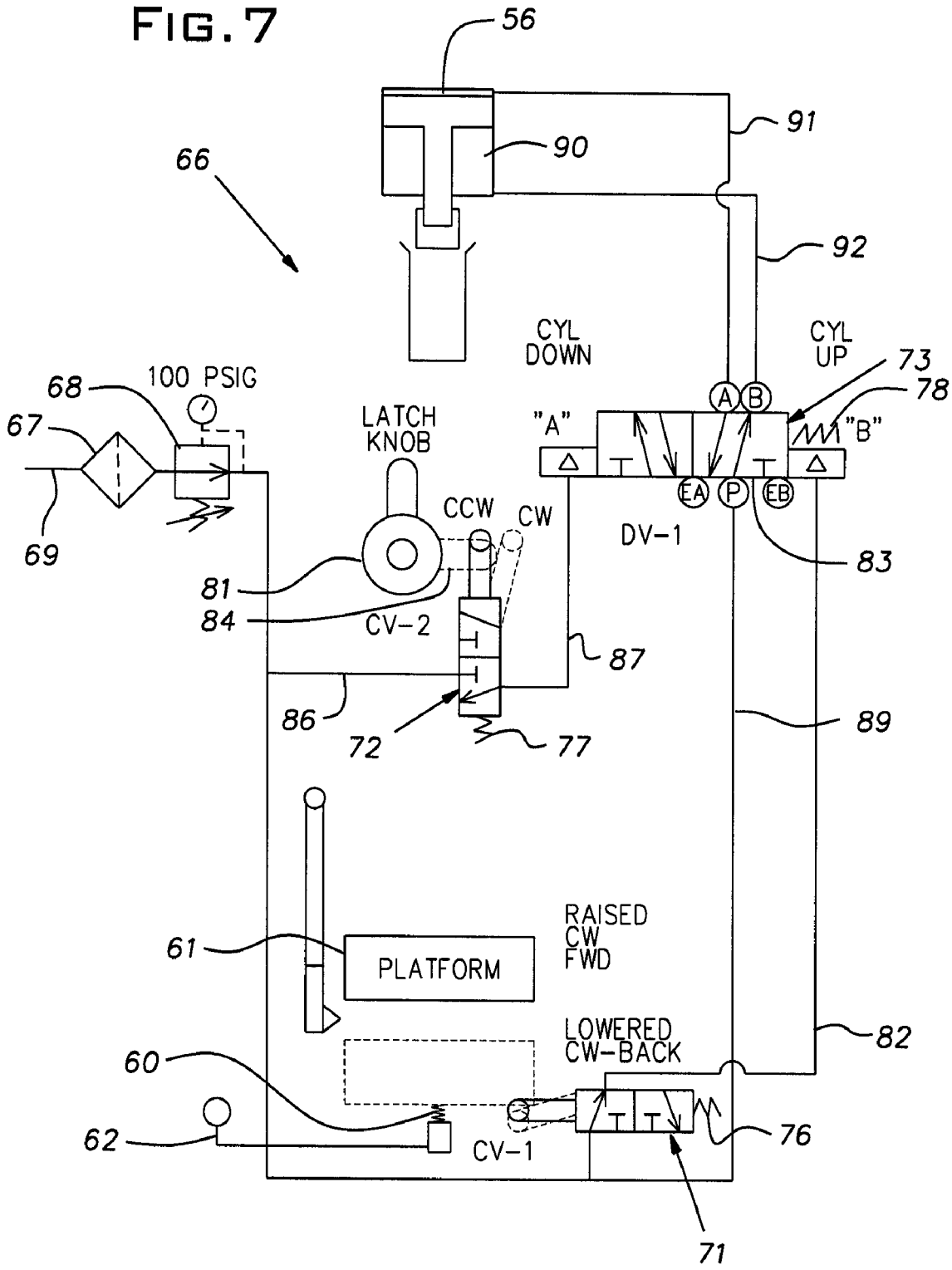
FIG. 7 is a schematic diagram of a pneumatic control circuit for the can filling system of the invention.

A pneumatic control circuit 66 of the can filling apparatus is illustrated in FIG. 7. The circuit 66 senses certain conditions in the apparatus and power operates the dispensing piston 44. The circuit 66 may include an air filter 67 and pressure regulator 68. A supply line 69 feeds air under pressure to the filter 67. The circuit 66 includes a limit poppet valve 71 disposed in the bottom of the housing 10 and a limit poppet valve 72 as well as a spool directional control valve 73 in the upper compartment 12. More specifically, the limit valves 71, 72 are mechanically operated 2-position, spring offset 3-way poppet valves. The valve 73 is a 5 ported double air piloted spring offset 4-way direction control valve. The valving elements of these respective valves 71-73 are biased to certain conditions by springs 76-78.

The limit valve 71 is responsive to the vertical position of the can support platform 61 while the limit valve 72 is responsive to the angular position of a latch knob 81 on the door 13. A vertical rod 84 (FIG. 1) within the housing 10 converts the pivotal latched and unlatched positions of the knob 81, respectively, to high or low positions of the rod which, in turn, are sensed by the limit valve 72. The latch knob 81 serves to hold the door 13 closed when it is in a latching position and unless the door 13 is closed, the vertical rod 84 cannot signal that the door is latched closed. The circuit 66, as will be explained, will cause the piston 33 of the pneumatic actuator 31 to force the dispensing piston 44 into the filling head bore 19 when the platform 61 is raised by operation of the lever 62 and the door 13 is latched by the knob 81. If either of these conditions, namely an elevated platform 61 or a latched knob 81 does not exist, the circuit 66 will maintain the pneumatic piston 33 in its upward retracted position or will initiate movement to this position.

In greater detail, when the can platform 61 is raised, the spring 76 shifts the poppet of its valve 71 leftward from the position shown in FIG. 7 such that it exhausts air pressure from a line 82 which removes any pressure bias towards the left on a spool 83 of the directional control valve 73. When the latch knob 81 is in a latching position to hold the door 13 closed, the poppet of the associated limit valve 72 is forced out of the position illustrated in FIG. 7 against the bias of the spring 77 to connect a pressurized line 86 to a pilot line 87. Pressure in the pilot line 87 drives the spool 83 to the right as viewed in FIG. 7 overcoming the bias of the spring 78. In the rightward position of the spool 83, a pressure line 89 supplies pneumatic pressure through the spool to a line 91 causing the pneumatic piston 33 to be forced downwardly by pressurizing the chamber 56 above it. Simultaneously, a chamber 90 below the piston 33 is exhausted through a line 92 in this rightward position of the spool 83. If the latch knob limit valve 72 supplies pilot pressure through the line 87, this pressure is ineffective to shift the spool 83 to extend the piston rod 34 where the platform 61 is lowered and the pilot line 82 fed by the limit valve 71 supplies pressure to the right side of the spool 83.

Whenever the latch knob is in an open position, the valve 72 reverts to the position illustrated in FIG. 7 and exhausts the pilot line 87 with the result that the spring 86 of the directional control valve 83 assumes the position indicated in FIG. 7 and the piston 33 is forced to retract by pressure delivered to the chamber 90 under the piston by the line 92. Regardless of the position of the latch knob and the valve 72 a lowering of the can platform 61 will cause the pilot line 82 to be pressurized and, with the assistance of the spring 86 will cause the spool of the directional control valve 73 to shift to the left taking the position illustrated in FIG. 7. Again, this latter situation will cause the piston 33 to retract. A benefit of the disclosed circuit 66 is that if a can is inadvertently subjected to over-filling such as would occur where there was an inadvertent attempt to fill it twice, the platform 61 will be depressed against the spring 60 by vertical expansion of the can and the limit valve 71 will be actuated to pressurize the pilot line 82 and, consequently, retract the piston 33. The operator of the apparatus can abort the fill sequence at any time by rotating the latch knob 81 to its unlatched position causing the piston 33 to retract. From the foregoing, it will be seen that the pneumatic control circuit 66 is exceptionally simple making it economical to construct, reliable in operation, and easy to trouble shoot if needed.

Currently, in the United States of America, for example, there are three popular aerosol can sizes, namely, 16, 12 and 6 ounce sizes. The apparatus of the invention includes a set of piston rod extensions 37*a*, 37*b*, and 37*c* (FIG. 3) of different lengths, each corresponding to an individual can size that is intended to be filled by the apparatus. Preferably, the dispensing chamber 19 is sized to hold a volume at least equal to the volume of the largest size can to be filled with the apparatus. The longest of the piston rod extensions 37*a* is used for filling the largest can size.

Smaller can sizes are filled using proportionately shorter length piston rod extensions, e.g. 37*b*, 37*c*. This methodology works because under normal conditions, the pneumatic piston 33 operates through a stroke of constant length which measured along the dispensing chamber 19 equates to a swept volume at least equal to the capacity of the largest can to be filled by the apparatus. When the volume of liquid to be dispensed into a can is less than the capacity of the dispensing chamber 19, a short piston rod extension 37*b*, or 37*c* is mounted on the piston rod 34. The upper end of each piston rod extension 37 has a threaded stud 36 that screws coaxially into a mating threaded blind hole 97 in the lower end of the piston rod 34. The portion of the stroke of the pneumatic piston 33 before the dispensing piston 44 enters the chamber 19 is ineffective to dispense liquid from the chamber because no hydraulic pressure can be developed by the dispensing piston during this movement when it is out of the chamber. The shorter the piston rod extension 37*b*, or 37*c*, the less liquid will be dispensed out of the chamber 19.

Figure 4:
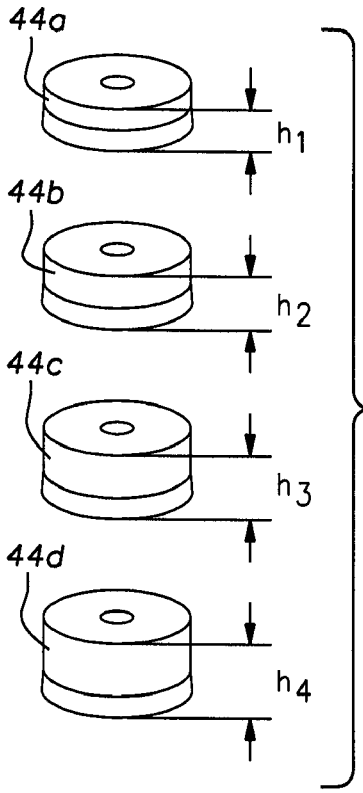
FIG. 4 is an illustration of a set of various height pistons used to provide fine adjustment of the injected liquid volume for the can filling system of the invention.

Government regulations specify that the contents of an aerosol can containing a liquid be specified by weight. The density of different liquids, or the same liquid with different additives including pigments, can vary considerably. This difference in density, when the contents are specified by weight, has a corresponding influence on the volume of a liquid. Economics dictates that a can should not be overfilled when, for example, a liquid is of relatively high density. The invention solves the problem of over filling by enabling the user to make minor adjustments to the volume of liquid dispensed into a can of a nominal regular size. This volume adjustment in accordance with the invention involves making minor axial adjustments to the position of the lower pressure developing face of the dispensing piston 44, relative to the pneumatic piston 33, that are small compared, for example, to the differences in the lengths of the piston rod extensions 37*a, b*, and *c*, that, as explained, account for different commercial regular can sizes. A preferred manner of accomplishing this minor adjustment is illustrated diagrammatically in FIG. 4 where a set of pistons 44*a-d* of varying height are provided. If a user wants to increase the dispensed volume, he selects a thicker or taller piston and, vise versa, if he wants to decrease the dispensed volume he selects a thinner or shorter piston. By way of example, the pistons can vary in thickness, i.e. height, by ⅛ inch. The same set of dispensing pistons 44*a-d* can be used with any of the illustrated piston rod extensions 37*a-c*. The same effect can be achieved by using a single thin piston with shims of different thickness and/or the same thickness but different numbers of shims. Alternatively, the shims can be interposed between the extension 37 and the pneumatic piston rod 34. Still further, it is contemplated that a screw adjustment of the piston or extension to slightly vary the position of the lower face of the dispensing piston 44 relative to the pneumatic piston rod 34 is contemplated. All of the foregoing techniques of varying the position of the lower face of the dispensing piston relative to the pneumatic piston rod 34 can, in accordance with the invention, effect a desired minor adjustment in the dispensing or fill volume of liquid being dispensed by the apparatus.

Figure 5:
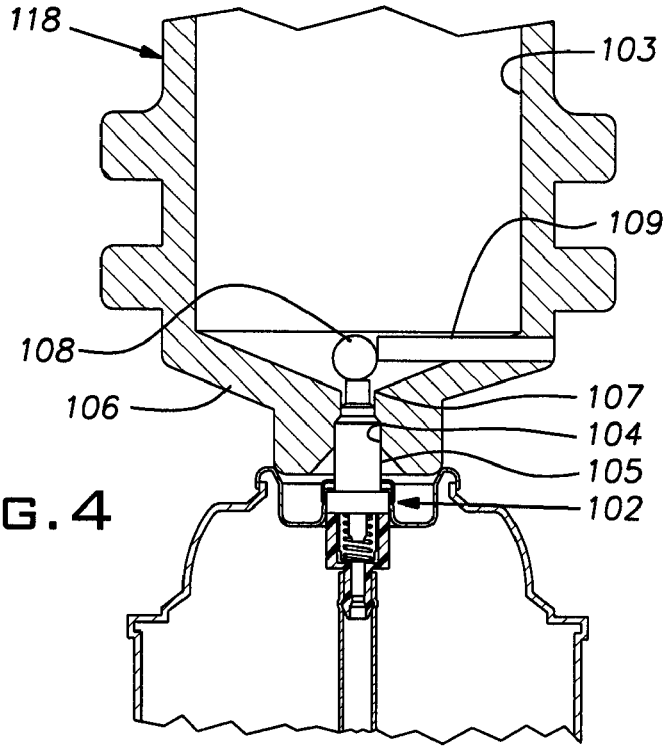
FIG. 5 is an enlarged cross-sectional view of the filling head of the invention for use with male tip valve style cans.
Figure 6:
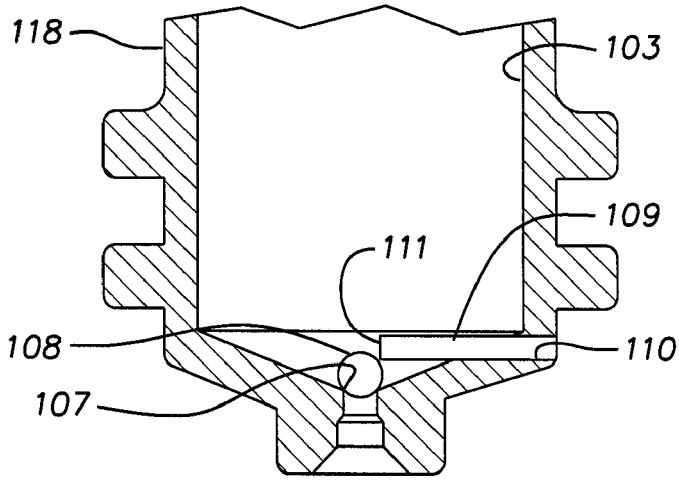
FIG. 6 is a view similar to FIG. 5 but without a male tip valve inserted.

Referring to FIGS. 5 and 6, there is shown a filling head 118 for use with a male tip style can valve 102. The filling head 118 can be substituted in the housing 10 for the head 18. The head 118 has a cylindrical dispensing chamber 103 corresponding to the chamber 19. Below the dispensing chamber 103 is a dispensing port 104 in the form of a stepped bore 104 through a bottom end wall 106 of the filling head. At an upper end of the bore or dispensing port 104 is a circular edge 107 that forms a valve seat for a valve ball 108 made of steel or other suitable material. A horizontal pin 109, such as a dowel pin, in the chamber 103 overlies the valve seat 107. The bore 104 is configured to couple in a liquid tight manner with a male valve tip or stem 105 of a can to be filled. Additionally, the bore 104 and surrounding parts of the end wall 106 are configured to cause the end of the male tip valve stem 105 to displace the ball 108 from the seat 107 when the stem projects through the plane of the seat 107. The dowel pin 109, preferably of non-magnetic stainless steel, fixed by a press fit in a hole 110 radial to the axis of the filling head chamber 103 extends from the side of the body of the filling head 118 radially to a zone generally above the seat 107. An end 111 of the pin 109 is situated in a path taken by the ball 108 when it is raised off of the seat 107 by the end of the stem 102 such that it constrains the ball 108 to a path preventing it from seating symmetrically on the upper end of the stem. The male tip or stem 102 is a hollow cylindrical tube typically molded of plastic. This deflection of the ball 108 from a vertical path that it would otherwise take as it is raised off the seat 107 by the stem tips the ball on the edge of the stem and thereby prevents the ball from seating on this edge. As a result, the liquid in the bore or chamber 103 can be dispensed into a can at a practical fill rate with moderate pressure developed on the liquid in the bore so that the pneumatic actuator can operate at normal shop pressure of, for example, about a 85 to about 110 psig.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A system for filling pre-charged aerosol cans comprising a frame, a power actuator on the frame having an output member that extends forcibly downwardly through a stroke of fixed length and retracts upwardly, a combined reservoir and filling head supported on the frame generally below the output member, the filling head having a cylindrical dispensing bore and an outlet below the bore adapted to be coupled to the valve of the aerosol can, at least one dispensing piston with a lower face operable in the bore to create hydraulic pressure on liquid received in the bore from the reservoir, a set of cooperating elements for coupling a dispensing piston to the output member selectively at a plurality of predetermined fixed spacings from the output member, whereby the volume of fluid displaced from the dispensing chamber by a dispensing piston is regulated to fill cans of different capacity while the output member of the power actuator traverses its stroke of constant length, said set of elements comprising elongated rods of different length, each of said rods being arranged at an upper end to couple with the output member and at a lower end to couple with the dispensing piston.

2. A system as set forth in claim 1, wherein said reservoir has a capacity to hold a volume of liquid that is a multiple of the volume of the chamber.

3. A system as set forth in claim 1, including a set of dispensing pistons of different heights such that a relatively fine adjustment to the volume of liquid dispensed in a power stroke can be effected by selection of an appropriate one of said pistons.

4. A system as set forth in claim 1, wherein said power actuator is operated by above atmospheric air pressure.

5. A system as set forth in claim 4, wherein said power actuator comprises a pneumatic piston and cylinder.

6. A system as set forth in claim 5, including a pneumatic circuit arranged to extend said output member by pressurizing one side of said piston.

7. A system as set forth in claim 5, wherein said frame includes a rectangular cabinet with a door on a side of the cabinet, a latch on said door to retain said door closed, a can support platform below and vertically aligned with said dispensing port and manually shiftable between a lower loading position and an upper filling head coupling position, said pneumatic circuit being semi-automatic and including a pair of limit valves, one of said limit valves sensing the position of the platform and the other sensing the position of the door latch, a control valve for operating said pneumatic piston and cylinder actuator and responsive to signals developed by said limit valves, said circuit and valves being arranged to drive said actuator to an extended position when said platform is in an elevated position and said door is latched and to a retracted position when either or both the platform is not in said elevated position and the door is unlatched.

8. A system as set forth in claim 1, wherein the filling head is arranged to couple with a female valve of an aerosol can.

9. A system as set forth in claim 1, wherein said filling head is arranged to couple with the male stem of the valve of an aerosol can.

10. A system as set forth in claim 9, wherein the filling head includes a valve ball and a seat arranged so that when a male stem of a can valve is inserted into said dispensing port, the ball is lifted from the seat, the head being arranged to shift the ball off center of the stem when the ball is lifted from the seat.

11. A system as set forth in claim 10, wherein said head includes a deflector suspended and fixed above said seat.

12. A filling head for dispensing liquid into a pre-charged aerosol can of the male stem valve type comprising a body having a cylindrical bore, a port in fluid communication with the bore and for coupling with the stem of the valve in a fluid tight manner, a valve seat between the bore and the port, a valve ball on a side of the seat facing the bore and operable to rest on the seat and thereby close the port, the port being arranged relative to the seat to enable the stem of a can being raised in the port to lift the valve ball off the seat to permit dispensing of liquid from the bore into the can, a constraining surface in the body off center of said valve seat that positively maintains the ball when lifted from the seat by the stem in a path where it is off center of the stem whereby the ball cannot fully seat on an upper edge of the stem so as to provide a practical fill rate with a moderate pressure developed on the liquid in the bore.

13. A method of varying the volume of liquid dispensed into a pre-charged aerosol can with a powered filling machine comprising the steps of providing the machine with a dispensing bore with a volume capacity at least as large as the largest can to be filled, providing a reservoir above the bore with a volume capacity of a plurality of said largest cans and capable of gravity feeding its liquid contents into the dispensing bore, disposing a dispensing piston over the dispensing bore and an actuator over the piston with the actuator being arranged to force the dispensing piston through a fixed stroke and into the bore, arranging the actuator such that the dispensing piston traveling through the fixed stroke sweeps a volume at least equal to the largest can volume to be filled, and adjusting the starting position of the dispensing piston above the bore before it is driven through the fixed stroke of the actuator to adjust the volume of liquid dispensed from said bore when said actuator drives said dispensing piston through its fixed stroke, the starting position adjustment being accomplished by selecting the length of a rod, from a series of optional different lengths, interposed between the piston and the actuator.

* * * * *